US011767569B2

(12) United States Patent
Andersson

(10) Patent No.: US 11,767,569 B2
(45) **Date of Patent: *Sep. 26, 2023**

(54) PRECIPITATION HARDENING STAINLESS STEEL AND ITS MANUFACTURE

(71) Applicant: OVAKO SWEDEN AB, Hofors (SE)

(72) Inventor: Jan-Erik Andersson, Falun (SE)

(73) Assignee: OVAKO SWEDEN AB, Hofors (SE)

( * ) Notice: Subject to any disclaimer, the term of this patent is extended or adjusted under 35 U.S.C. 154(b) by 41 days.

This patent is subject to a terminal disclaimer.

(21) Appl. No.: 16/306,464

(22) PCT Filed: May 31, 2017

(86) PCT No.: PCT/EP2017/063194

§ 371 (c)(1),
(2) Date: Nov. 30, 2018

(87) PCT Pub. No.: WO2017/207652

PCT Pub. Date: Dec. 7, 2017

(65) Prior Publication Data

US 2019/0127814 A1 May 2, 2019

(30) Foreign Application Priority Data

Jun. 1, 2016 (SE) ..... 1650764-2

(51) Int. Cl.

| | |
|---|---|
| ***C22C 38/40*** | (2006.01) |
| ***C21D 6/02*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/46*** | (2006.01) |
| ***C21D 1/25*** | (2006.01) |
| ***C22C 38/08*** | (2006.01) |
| ***C22C 38/12*** | (2006.01) |
| ***C21D 6/00*** | (2006.01) |
| ***C21D 1/06*** | (2006.01) |
| ***C23C 8/02*** | (2006.01) |
| ***C23C 8/26*** | (2006.01) |
| *C21D 1/18* | (2006.01) |

(52) U.S. Cl.

CPC ..... *C21D 6/02* (2013.01); *C21D 1/06* (2013.01); *C21D 1/25* (2013.01); *C21D 6/004* (2013.01); *C21D 6/005* (2013.01); *C21D 6/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/40* (2013.01); *C22C 38/44* (2013.01); *C22C 38/46* (2013.01); *C23C 8/02* (2013.01); *C23C 8/26* (2013.01); *C21D 1/18* (2013.01); *C21D 2211/001* (2013.01); *C21D 2211/004* (2013.01); *C21D 2211/008* (2013.01)

(58) Field of Classification Search

CPC ..... C21D 6/02

See application file for complete search history.

(56) References Cited

U.S. PATENT DOCUMENTS

| | | | | |
|---|---|---|---|---|
| 4,902,472 | A | 2/1990 | Isobe et al. | |
| 5,202,089 | A * | 4/1993 | Norstrom | C22C 38/40 148/318 |
| 5,393,488 | A | 2/1995 | Rhoads et al. | |
| 6,193,469 | B1 * | 2/2001 | Tsuda | C21D 9/38 148/609 |
| 2011/0255988 | A1 | 10/2011 | Oikawa et al. | |
| 2012/0114496 | A1 | 5/2012 | Oikawa et al. | |
| 2013/0186106 | A1 | 7/2013 | Oikawa et al. | |
| 2013/0224033 | A1 * | 8/2013 | Arai | F01D 5/28 416/223 R |

(Continued)

FOREIGN PATENT DOCUMENTS

| | | |
|---|---|---|
| EP | 0459547 A1 | 12/1991 |
| EP | 0867522 B1 | 8/2003 |

(Continued)

OTHER PUBLICATIONS

Examination Report from corresponding Indian Application No. 201817049119 dated Jun. 28, 2021.

(Continued)

*Primary Examiner* — Jophy S. Koshy
(74) *Attorney, Agent, or Firm* — Porter Wright Morris & Arthur LLP

(57) ABSTRACT

There is provided a precipitation hardening stainless steel with the composition: C: 0.05-0.30 wt %, Ni: 9-10 wt %, Mo: 0.5-1.5 wt %, Al: 1.75-3 wt %, Cr: 10.5-13 wt %, V: 0.25-1.5 wt %, Co: 0-0.03 wt %, Mn: 0-0.5 wt %, Si: 0-0.3 wt %, and remaining part up to 100 wt % is Fe and impurity elements, with the additional proviso that the amounts of Al and Ni also fulfil Al=Ni/4±0.5 in wt %. Further $Cr_{eq}$ is in the interval 11-15.4 wt % and $Ni_{eq}$ is in the interval 10.5-15 wt %. There is the possibility to have very low amounts of cobalt, well below 0.01 wt %. The precipitation hardening stainless steel displays, low segregation, high yield strength at elevated temperatures, and can also suitably be nitrided. The precipitation hardening stainless steel is more economical to manufacture compared to stainless steel according to the state of the art with the same strength at elevated temperatures.

14 Claims, 5 Drawing Sheets

(56) References Cited

U.S. PATENT DOCUMENTS

2014/0105753 A1* 4/2014 Oikawa ..... F01D 5/28
416/241 R

FOREIGN PATENT DOCUMENTS

| | | | |
|---|---|---|---|
| EP | 2617856 | A1 | 7/2013 |
| JP | 62-20857 | A | 1/1987 |
| JP | 2-179849 | A | 7/1990 |
| JP | 02310339 | A | 12/1990 |
| JP | 4-63261 | A | 2/1992 |
| JP | 11-140591 | A | 5/1999 |
| JP | 2000-054068 | A | 2/2000 |
| JP | 2000-119799 | A | 4/2000 |
| JP | 3385603 | B2 | 3/2003 |
| JP | 4232128 | B2 | 3/2009 |
| JP | 2011-225913 | A | 11/2011 |
| JP | 2013-147698 | A | 8/2013 |
| JP | 2014-80656 | A | 5/2014 |

OTHER PUBLICATIONS

Office Action from corresponding Japanese Application No. 2018-563606 dated Mar. 2, 2021, with English Translation.
Office Action from corresponding Korean Application No. 10-2018-7036781 dated Apr. 26, 2022, with English Translation.
Search Report from corresponding Swedish Application No. 1650764-2 dated Nov. 29, 2016.

* cited by examiner

Tempering Hardness at 520°C
Measured on automatic hardness tester KB30S

| | C | Si | Mn | Cr | Mo | V | Ni | Al |
|---|---|---|---|---|---|---|---|---|
| Invented Steel | 0.15 | 0.3 | 0.3 | 12.2 | 0.7 | 0.5 | 9.2 | 2 |
| Steel 1 | 0.2 | 0.1 | 0.3 | 5 | 0.7 | 0.5 | 0.1 | 0.025 |
| Steel 2 | 0.2 | 0.1 | 1 | 1 | 0.05 | 0.05 | 0.1 | 0.025 |

PRECIPITATION HARDENING STAINLESS STEEL AND ITS MANUFACTURE

TECHNICAL FIELD

The present invention relates generally to high strength precipitation hardening stainless steel suitable for use at elevated temperature. The precipitation hardening stainless steel composition is optimized to give both precipitation hardening with carbides together with an inter-metallic precipitation of Ni—Al present after tempering. The new steel comprises a high proportion of a martensitic phase and designed to have a low micro and macro segregation. It is possible to provide a steel which is essentially cobalt free.

BACKGROUND

Primary hardening is when the steel is quenched from the austenitic phase field into a martensitic or bainitic microstructure. Generally steels comprising carbides are known. Low alloy carbon steels generates iron carbides during tempering. These carbides coarsen at elevated temperatures which reduces the strength of the steel. When steels contain strong carbide forming elements such as molybdenum, vanadium and chromium, the strength can be increased by prolonged tempering at elevated temperatures. This is due to that alloyed carbides will precipitate at certain temperatures. Normally these steels reduce their primary hardened strength when tempered at 100° C. to 450°. At 450° C. to 550° C. these alloyed carbides precipitate and increase the strength up to or even higher than the primary hardness, this is called secondary hardening. It occurs since the alloying elements (such as molybdenum, vanadium and chromium) can diffuse during prolonged annealing to precipitate finely dispersed alloy carbides. The alloy carbides found in secondary hardened steels are thermodynamically more stable than iron carbides and show little tendency to coarsen.

Inter metallic precipitation hardening steels are also known. Both the carbide precipitation and inter metallic precipitation hardening relies on changes in solid solubility with temperature to produce fine particles of an impurity phase, which impede the movement of dislocations, or defects in a crystal lattice. Since dislocations are often the dominant carriers of plasticity, this serves to harden the material. Precipitation hardening steels may for instance comprise aluminum and nickel, forming the impurity phase.

The presence of second phase particles often causes lattice distortions. These lattice distortions result when the precipitate particles differ in size and crystallographic structure from the host atoms. Smaller precipitate particles in a host lattice leads to a tensile stress, whereas larger precipitate particles leads to a compressive stress. Dislocation defects also create a stress field. Above the dislocation there is a compressive stress and below there is a tensile stress. Consequently, there is a negative interaction energy between a dislocation and a precipitate that each respectively cause a compressive and a tensile stress or vice versa. In other words, the dislocation will be attracted to the precipitate. In addition, there is a positive interaction energy between a dislocation and a precipitate that have the same type of stress field. This means that the dislocation will be repulsed by the precipitate.

Precipitate particles also serve by locally changing the stiffness of a material. Dislocations are repulsed by regions of higher stiffness. Conversely, if the precipitate causes the material to be locally more compliant, then the dislocation will be attracted to that region.

Steels comprising both alloy carbides and intermetallic precipitates are rare, but they are known. Those steels are however not optimized for low segregation or for optimized hardness after tempering. For instance U.S. Pat. No. 5,393,488 discloses a steel with a duplex hardening mechanism both with intermetallic precipitates and alloy carbides. This steel comprises C: up to 0.30 wt %
Ni: 10-18 wt %
Mo: 1-5 wt %
Al: 0.5-1.3 wt %
Cr: 1.75-3 wt %
Co: 8-16 wt %.

It is known that cobalt has negative health effects as well as negative environmental effects. At the same time it is desirable to increase the properties in general and in particular the strength at high temperature.

Every steel grade will segregate more or less depending on steel composition. Numerous of steel grades have been examined for the variations of chemical compositions. Carbon has an enormous influence on the partitioning of various carbide forming elements, such as Mo Cr and V. The higher the carbon content, the more segregation will occur. Both on a micro and a macro scale. The absolute value of Cr, Mo or V will be the segregation index multiplied with the nominal content of the steel. Since chromium has a low tendency to segregate, a loose restriction of the amount can be set. The amount of Mo and V on the other hand should be controlled up to 1.0-1.5 wt % because of their tendency to segregate.

M-50 steel is often refined using vacuum-induction melting (VIM) and vacuum-arc remelting (VAR) processes, and it exhibits excellent resistance to multi-axial stresses and softening at high service temperatures as well as good resistance to oxidation. However it suffers from segregation, which would be desirable to avoid. Further it is fairly expensive to manufacture.

In view of this it is a problem in the art how to provide a stainless steel where it is possible to have negligible amounts of cobalt which at the same time has both low segregation and improved mechanical properties also at elevated temperatures.

SUMMARY

It is an object of the present invention to obviate at least some of the disadvantages in the prior art and provide an improved stainless steel.

In a first aspect there is provided a precipitation hardening stainless steel, said stainless steel comprising in wt %:

C: 0.05-0.30 wt %
Ni: 9-10 wt %
Mo: 0.5-1.5 wt %
Al: 1.75-3 wt %
Cr: 10.5-13 wt %
V: 0.25-1.5 wt %
Co: 0-0.03 wt %
Mn: 0-0.5 wt %
Si: 0-0.3 wt % remaining part up to 100 wt % is Fe and impurity elements, wherein the steel comprises more than or equal to 80 wt %, preferably more than or equal to 90 wt % of a martensitic phase, wherein the composition of said stainless steel is within an area formed in a Schaeffler diagram, which diagram is based on the following equations:

$$Cr_{eq}=Cr+Mo+1.5*Si+0.5*Nb \text{ in wt \% on the } x\text{-axis}$$

$$Ni_{eq}=Ni+30*C+0.5*Mn \text{ in wt \% on the } y\text{-axis}$$

wherein the area in the Schaeffler diagram is defined by $11 \leq Cr_{eq} \leq 15.4$ and $10.5 \leq Ni_{eq} \leq 15$ in wt %,
with the additional proviso that the amounts of Al and Ni also fulfil a formula Al=(Ni/4)±0.5 in wt %, and with the proviso that the amount of Al is 1 wt % if the formula results in an amount of Al lower than 1 wt % and that the amount of Al is 3 wt % if the formula results in an amount of Al exceeding 3 wt %.

In a second aspect there is provided a method of manufacturing a part of the precipitation hardening stainless steel described above characterized in that the precipitation hardening stainless steel is tempered at 510-530° C. to obtain precipitates comprising Ni and Al.

In a third aspect there is provided use of the precipitation hardening stainless steel as described above for applications where the precipitation hardening stainless steel is subjected to a temperature during use from 250 to 300° C. In an alternative embodiment there is provided use of the precipitation hardening stainless steel described above for applications where the precipitation hardening stainless steel is subjected to a temperature during use from 300 to 500° C. In yet another embodiment there is provided use of the precipitation hardening stainless steel as described above for applications where the precipitation hardening stainless steel is subjected to a temperature during use from 250 to 500° C.

Further aspects and embodiments are defined in the appended claims.

One advantage is that the precipitation hardening stainless steel can be provided with only trace amounts of undesired cobalt. It is possible to use cobalt levels well below 0.01 wt %. The amounts are so low that any undesired effects are avoided. Low amounts of cobalt are preferred because of the environmental and health problems associated with cobalt.

Another advantage is that the strength at elevated temperatures is increased. Elevated temperatures where the strength is increased are typically 250-300° C. or even up to 500° C. In one embodiment the upper temperature limit for the suitable use of the precipitation hardening stainless steel is 450° C.

The precipitation hardening stainless steel is more economical to manufacture compared to present steels with the same strength at elevated temperatures.

Yet another advantage is that the precipitation hardening stainless steel is suitable for nitriding.

BRIEF DESCRIPTION OF THE DRAWINGS

The invention is now described, by way of example, with reference to the accompanying drawings, in which.

DETAILED DESCRIPTION

Figure 1:
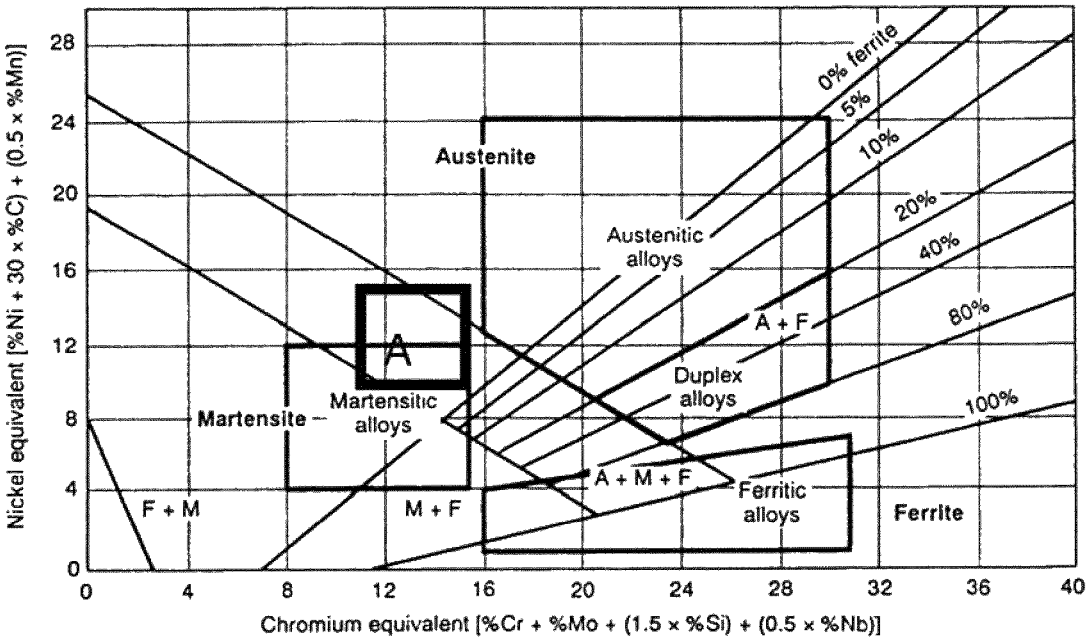
FIG. 1 shows a Schaeffler diagram with $Cr_{eq}$=Cr+Mo+1.5*Si+0.5*Nb in wt % on the x-axis and $Ni_{eq}$=Ni+30*C+0.5*Mn in wt % on the y-axis. The area defined by $11 \leq Cr_{eq} \leq 15.4$ and $10.5 \leq Ni_{eq} \leq 15$ in wt % is depicted as the area A.

Before the invention is disclosed and described in detail, it is to be understood that this invention is not limited to particular compounds, configurations, method steps, substrates, and materials disclosed herein as such compounds, configurations, method steps, substrates, and materials may vary somewhat. It is also to be understood that the terminology employed herein is used for the purpose of describing particular embodiments only and is not intended to be limiting since the scope of the present invention is limited only by the appended claims and equivalents thereof.

It must be noted that, as used in this specification and the appended claims, the singular forms "a", "an" and "the" include plural referents unless the context clearly dictates otherwise.

If nothing else is defined, any terms and scientific terminology used herein are intended to have the meanings commonly understood by those of skill in the art to which this invention pertains.

Essentially cobalt free and similar expressions mean that only trace amounts of cobalt are present. In one embodiment essentially cobalt free is an amount below a suggested threshold for cobalt of 0.01 wt %.

All percentages are calculated by weight, unless otherwise clearly indicated. The composition of steels are given in wt %. All ratios are calculated by weight, unless otherwise clearly indicated.

In a first aspect there is provided a precipitation hardening stainless steel, said stainless steel comprising in wt %:

C: 0.05-0.30 wt %
Ni: 9-10 wt %
Mo: 0.5-1.5 wt %
Al: 1.75-3 wt %
Cr: 10.5-13 wt %
V: 0.25-1.5 wt %
Co: 0-0.03 wt %
Mn: 0-0.5 wt %
Si: 0-0.3 wt % remaining part up to 100 wt % is Fe and impurity elements, wherein the steel comprises more than or equal to 80 wt %, preferably more than or equal to 90 wt % of a martensitic phase, wherein the composition of said stainless steel is within an area formed in a Schaeffler diagram, which diagram is based on the following equations:

$$Cr_{eq}=Cr+Mo+1.5*Si+0.5*Nb \text{ in wt \% on the } x\text{-axis}$$

$$Ni_{eq}=Ni+30*C+0.5*Mn \text{ in wt \% on the } y\text{-axis}$$

wherein the area in the Schaeffler diagram is defined by $11 \leq Cr_{eq} \leq 15.4$ and $10.5 \leq Ni_{eq} \leq 15$ in wt %,
with the additional proviso that the amounts of Al and Ni also fulfil a formula Al=(Ni/4)±0.5 in wt %, and with the proviso that the amount of Al is 1 wt % if the formula results in an amount of Al lower than 1 wt % and that the amount of Al is 3 wt % if the formula results in an amount of Al exceeding 3 wt %.

The amounts of all elements are in wt %.

The precipitation hardening stainless steel has a martensitic structure comprising both a martensitic phase as well as other phases such as an austenitic phase. The precipitation hardening stainless steel comprises more than or equal to 80 wt % of a martensitic phase, preferably more than 85 wt %, more preferably more than 90 wt % even more preferably more than 95 wt % of a martensitic phase. In one embodiment the precipitation hardening stainless steel comprises more than or equal to 92 wt % of a martensitic phase. In one embodiment the precipitation hardening stainless steel comprises more than or equal to 94 wt % of a martensitic phase. The martensitic phase provides hardness and tensile strength as well as wear resistance. According to the present invention a martensitic phase and an austenitic phase will form.

The amount of austenite phase should not be too high because it will lower the desired hardness. The martensitic phase is desired.

In one embodiment with a steel according to the invention comprising 13 wt % Cr, 9 wt % Ni, 2 wt % Al and 0.15 wt % C the austenitic phase will be 15 wt % of the material. However since the amount of austenite is temperature dependent it can be lowered by cooling. In one embodiment the amount of austenitic phase will be lowered to about 6 wt % for the same steel by cooling to −40° C. This will increase the hardness.

The Schaeffler diagram in FIG. 1 is used to predict the presence of for instance a martensitic phase in the structure of steel after a fast cooling from high temperature and is based on the chemical composition of the steel.

It must be noted that the Schaeffler diagram and the martensitic area indicated within it is only a fairly coarse overview. Thus even if the Schaeffler diagram shows that a composition is outside the martensitic area, it will nevertheless be possible to obtain a high amount of martensitic phase in the rectangle designated A in FIG. 1. This explains why the area A according to the invention is partially outside the martensitic area. Even for the part of the area A outside the martensitic area it is possible to obtain a high degree of a martensitic phase in the steel.

Carbon (C): 0.05 to 0.3 wt %. In an alternative embodiment the amount of C is 0.05 to 0.2 wt %. C is a strong austenite phase stabilizing alloying element. C is necessary for the martensitic stainless steel so that said steel has the ability to be hardened and strengthened by heat treatment. An excess of C will increase the risk of forming chromium carbide, which would thus reduce various mechanical properties and other properties, such as ductility, impact toughness and corrosion resistance. The mechanical properties are also affected by the amount of retained austenite phase after hardening and this amount will depend on the C-content. Accordingly, the C-content is set to be at most 0.3 wt %. In an alternative embodiment the maximum C-content is 0.2 wt %.

Nickel (Ni) 9-10 wt %. In the present disclosure, it has been found that by balancing the amount of Ni and Al a first type of precipitations comprising Al and Ni are obtained. Thus the amount of Ni should be balanced with the amount of Al to fulfil the formula in the claim. Preferably the amount of Ni is kept as low as possible while still obtaining the desired properties, since Ni is a fairly expensive ingredient. Further a too high amount of Ni will increase the amount of an austenitic phase in the material and this should be avoided because the steel will then be too soft.

Molybdenum (Mo): 0.5-1.5 wt %. Mo is a strong ferrite phase stabilizing alloying element and thus promotes the formation of the ferrite phase during annealing or hot-working. One major advantage of Mo is that it contributes to the corrosion resistance. Mo is also known to reduce the temper embrittlement in martensitic steels and thereby improves the mechanical properties. However, Mo is an expensive element and the effect on corrosion resistance is obtained even in low amounts. The lowest content of Mo is therefore 0.5 wt %. Furthermore, an excessive amount of Mo affects the austenite to martensite transformation during hardening and eventually the retained austenite phase content. Therefore, the upper limit of Mo is set at 1.5 wt %.

Aluminum (Al) 1.75-3 wt %. Al is an element commonly used as a deoxidizing agent as it is effective in reducing the oxygen content during steel production. In the steel aluminum forms a first type of precipitations together with Ni to improve the mechanical properties. In one embodiment the amount of Al is 2 wt %. The relation between Al and Ni is determined by the formula Al=Ni/4 and adding the marginal±0.5 wt %. The formula Al=Ni/4±0.5 should be used with the amounts of Al and Ni expressed in weight percent. The formula gives an additional condition to be fulfilled together with all other conditions. Assuming that Ni=10 wt %, then this formula gives that Al=2.5±0.5 wt %, i.e. in the interval 2 to 3 wt %. However there is also the condition that the amount of Al is 1.75-3 wt %. The latter condition shall in the present disclosure be interpreted so that if the first formula gives an amount of Al which is 3 wt % or higher, then 3 wt % Al should be used. If the first formula gives an amount of Al which is 1.75 wt % or lower, then 1.75 wt % Al should be used. Thus the formula gives an additional condition which should be applied together with the other conditions regarding the amounts of Al and Ni. Both conditions shall be applied. Assuming that Ni=9 wt %, then this formula gives that Al=2.25±0.5 wt %. However there is also the condition that the amount of Al is 1.75-3 wt %. These conditions together give that Al should be between 1.75 and 2.75 wt %.

Chromium (Cr) 10.5-13 wt % is one of the basic alloying elements of a stainless steel and an element which will provide corrosion resistance to the steel by forming a protective layer of chromium oxide on the surface. The precipitation hardening stainless steel as defined hereinabove or hereinafter comprises at least 10.5 wt % in order to achieve a Cr-oxide layer and/or a passivation of the surface of the steel in air or water, thereby obtaining the basic corrosion resistance. However, if Cr is present in an excessive amount, the impact toughness may be decreased and chromium carbides may be formed upon hardening. The formation of chromium carbides will reduce the mechanical properties of the martensitic stainless steel. An increase of the Cr-content above the level for passivation of the steel surface will have only weak effects on the corrosion resistance of the martensitic stainless steel. The Cr-content is therefore set to be at most 13 wt %. In an alternative embodiment the Cr-content is allowed to be at most 15 wt %. However a high amount of Cr will increase the amount of an austenitic phase in the material and this should be avoided because the steel will then be too soft. Thus a high amount of Cr is undesired for many applications.

Vanadium (V): 0.25-1.5 wt %. V is an alloying element which has a high affinity to C and N. V is a precipitation hardening element and is regarded as a micro-alloying element in the precipitation hardening stainless steel and may be used for grain refinement. Grain refinement refers to a method to control grain size at high temperatures by introducing small precipitates in the microstructure, which will restrict the mobility of the grain boundaries and thereby will reduce the austenite grain growth during hot working or heat treatment. A small austenite grain size is known to improve the mechanical properties of the martensitic microstructure formed upon hardening. The steel comprises a second type of precipitations comprising carbides of at least one selected from the group consisting of Cr, Mo and V. These precipitations together with the first type of precipitations comprising Al and Ni give improved mechanical properties.

Cobalt (Co): 0-0.03 wt %. In one embodiment the amount of Co less than 0.03 wt %. In one embodiment the amount of Co less than 0.02 wt %. In another embodiment the amount of Co is less than 0.01 wt %. It has been proposed that cobalt should be labelled as carcinogenic category 1B H350 with a specific concentration limit (SCL) of 0.01 wt %, i.e. a cobalt content of more than 0.01 wt % could potentially be harmful. A low cobalt content is desired and in yet another embodiment the amount of Co is less than 0.005 wt %. In one embodiment there is a lower limit of Co of 0.0001 wt %. It is an advantage of the invention that it is possible to have a very low amount of cobalt while the desired properties remain. The amount of cobalt is or can at least be made so low that the precipitation hardening stainless steel can be called cobalt free. The low amount of cobalt does not give impaired properties in other respects such as mechanical properties or strength at high temperature.

Manganese (Mn): 0-0.5 wt %. Mn is an austenite phase stabilizing alloying element. However, if the Mn-content is excessive, the amount of retained austenite phase may become too large and various mechanical properties, as well as hardness and corrosion resistance, may be reduced. Also, a too high content of Mn will reduce the hot working properties and also impair the surface quality. In one embodiment Mn is 0-0.3 wt %. In one embodiment the lower limit of Mn is 0.001 wt %. The mentioned concentrations of Mn do not adversely affect the properties of the precipitation hardening stainless steel to a noticeable extent. Mn is a common element in steel in low concentrations. Regarding Mn the skilled person must consider that it affects the total amount of $Ni_{eq}$ and the skilled person then may have to adapt the concentration of other nickel equivalents. The same applies to all other nickel equivalents.

Silicon (Si): 0-0.3 wt %. Si is a strong ferrite phase stabilizing alloying element and therefore its content will also depend on the amounts of the other ferrite forming elements, such as Cr and Mo. Si is mainly used as a deoxidizer agent during melt refining. If the Si-content is excessive, ferrite phase as well as intermetallic precipitates may be formed in the microstructure, which will reduce various mechanical properties. Accordingly, the Si-content is set to be max 0.3 wt %. In one embodiment the amount of Si is 0-0.15 wt %. In one embodiment the lower limit of Si is 0.001 wt %.

Optionally small amounts of other alloying elements may be added to the martensitic stainless steel as defined hereinabove or hereinafter in order to improve e.g. the machinability or the hot working properties, such as the hot ductility. Example, but not limiting, of such elements are Ca, Mg, B, Pb and Ce. The amounts of one or more of these elements are of max. 0.05 wt %.

When the terms "max" or "less than or equal to" are used, the skilled person knows that the lower limit of the range is 0 wt % unless another number is specifically stated.

The remainder of elements of the martensitic stainless steel as defined hereinabove or hereinafter is Iron (Fe) and normally occurring impurities. Examples of impurities are elements and compounds which have not been added on purpose, but cannot be fully avoided as they normally occur as impurities in e.g. the raw material or the additional alloying elements used for manufacturing of the martensitic stainless steel.

The term "impurity elements" is used to include, in addition to iron in the balance of the alloy, small amounts of impurities and incidental elements, which in character and/or amount do not adversely affect the advantageous aspects of the precipitation hardening stainless steel alloy. The bulk of the alloy may contain certain normal levels of impurities, examples include but are not limited to up to about 30 ppm each of nitrogen, oxygen and sulfur.

The steel comprises a martensitic phase with the remaining part made up of mainly austenitic phase. The martensitic phase is desired, otherwise the steel will be too soft.

The precipitation hardening steel composition is further within an area formed in a Schaeffler diagram. The area is defined by $11 \leq Cr_{eq} \leq 15.4$ and $10.5 \leq Ni_{eq} \leq 15$ in wt %. $Cr_{eq}$=Cr+Mo+1.5*Si+0.5*Nb in wt % is on the x-axis. $Ni_{eq}$=Ni+30*C+0.5*Mn in wt % is on the y-axis.

It is understood that the amounts for the elements such as Ni, C and the elements such as Cr and Mo are not freely adjustable within the ranges but have to be adapted to the Scheaffler diagram, since for instance C is a Ni equivalent and Mo is a Cr equivalent.

A content of 0.05-0.3 wt % C and 9-10 wt % Ni has to be combined with the additional condition that $Ni_{eq}$ is in the interval 10.5-15. 0.05 wt % C and 9 wt % Ni gives a $Ni_{eq}$ of 10.5. 0.05 wt % C and 10 wt % Ni gives a $Ni_{eq}$ of 11.5. All conditions of the last sentence have to be fulfilled.

Similar for a content of 10.5-13 wt % Cr and 0.5-1.5 wt % Mo it has to be combined with the additional condition that $Cr_{eq}$ is in the interval 11-15.4. All conditions of the last sentence have to apply. It may be the case that the upper limit of $Cr_{eq}$ 15.4 cannot be reached, but this is as intended.

In one embodiment the precipitation hardening stainless steel comprises a first type of precipitations comprising Al and Ni and a second type of precipitations comprising carbides of at least one selected from the group consisting of Cr, Mo and V. The two types of precipitations give improved mechanical properties.

In a second aspect there is provided a method of manufacturing a part of the precipitation hardening stainless steel as described above wherein the precipitation hardening stainless steel is tempered at 510-530° C. to obtain precipitates comprising Ni and Al. This gives the precipitations comprising Al and Ni. In one embodiment the precipitation hardening stainless steel is tempered at 520° C. In another embodiment the precipitation hardening stainless steel is tempered at 520° C.±2%. In one embodiment the precipitation hardening stainless steel is tempered for 1-8 hours. In one embodiment the precipitation hardening stainless steel is tempered for 6-8 hours. In yet another embodiment the precipitation hardening stainless steel is tempered at 6 hours±0.5 hours.

In one embodiment the precipitation hardening stainless steel is machined before the tempering. This has the advantage that the precipitation hardening stainless steel has lower strength before the tempering compared to after the tempering and is thereby easier to machine before the tempering compared to after the tempering. For a steel that has essentially the same content except for Al, there is virtually no increase in hardness, whereas for a steel according to the invention an increase in hardness occurs. The increase in hardness is attributed to the formation of precipitates comprising Ni and Al. Steel with either secondary hardening elements or Ni—Al addition has limited hardness after tempering.

In one embodiment solution treatment is carried out before the tempering. In one embodiment the solution treatment is carried out in the temperature interval 900-1000° C. during 0.2-3 h. The composition should be chosen so that a solution treatment is possible in the austenitic phase field. Cr, Al, and Mo stabilizes ferrite whereas Mn and Ni stabilizes austenite.

In a third aspect there is provided use of the as described above for applications where the precipitation hardening stainless steel is subjected to a temperature during use from 250 to 300° C. In an alternative embodiment there is provided use of the precipitation hardening stainless steel described above for applications where the precipitation hardening stainless steel is subjected to a temperature during use from 300 to 500° C. In yet another embodiment there is provided use of the precipitation hardening stainless steel as described above for applications where the precipitation hardening stainless steel is subjected to a temperature during use from 250-500° C. In a further embodiment there is provided use of the precipitation hardening stainless steel as described above for applications where the precipitation hardening stainless steel is subjected to a temperature during use from 250-450° C.

The precipitation-hardening process can be proceeded by solution treatment, or solutionizing, is the first step in the precipitation-hardening process where the alloy is heated above the solidus temperature until a homogeneous solid solution is produced.

Nitriding is a heat treating process that diffuses nitrogen into the surface of a metal to create a case-hardened surface. The content of Cr, Mo and Al makes the precipitation hardening stainless steel suitable for nitriding. The nitriding is suitably used for further improving the mechanical properties. In one embodiment nitriding of the precipitation hardening stainless steel is carried out.

All the described alternative embodiments above or parts of an embodiment can be freely combined without departing from the inventive idea as long as the combination is not contradictory.

Other features and uses of the invention and their associated advantages will be evident to a person skilled in the art upon reading the description and the examples.

It is to be understood that this invention is not limited to the particular embodiments shown here. The embodiments are provided for illustrative purposes and are not intended to limit the scope of the invention since the scope of the present invention is limited only by the appended claims and equivalents thereof.

EXAMPLES

Figure 2:
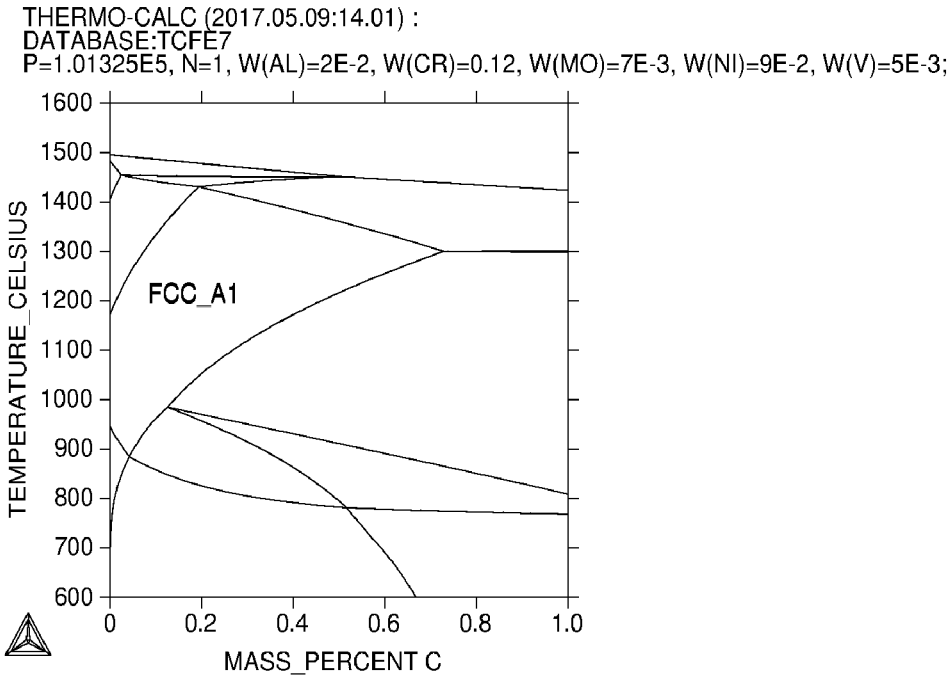
FIG. 2 shows a calculated diagram of as detailed in Example 1 with the FCC area indicated.

A simulation was performed using the software Thermo-Calc of a steel according to the invention with 12 wt % Cr, 2 wt % Al, 0.7 wt % Mo, 0.5 wt % V and 9 wt % Ni. The remaining compounds according to claim 1 were within the boundaries of the invention and the amount of C was varied as shown on the X-axis in FIG. 2. It is desirable to be in the FCC area.

A steel with the following specification in wt % was made:

| C | Si | Mn | Cr | Mo | V | Ni | Al |
|---|---|---|---|---|---|---|---|
| 0.15 | 0.3 | 0.3 | 12.2 | 0.7 | 0.5 | 9.2 | 2 |

Calculations show that the steel comprises about 90 wt % of a martensitic phase.

Figure 3A:
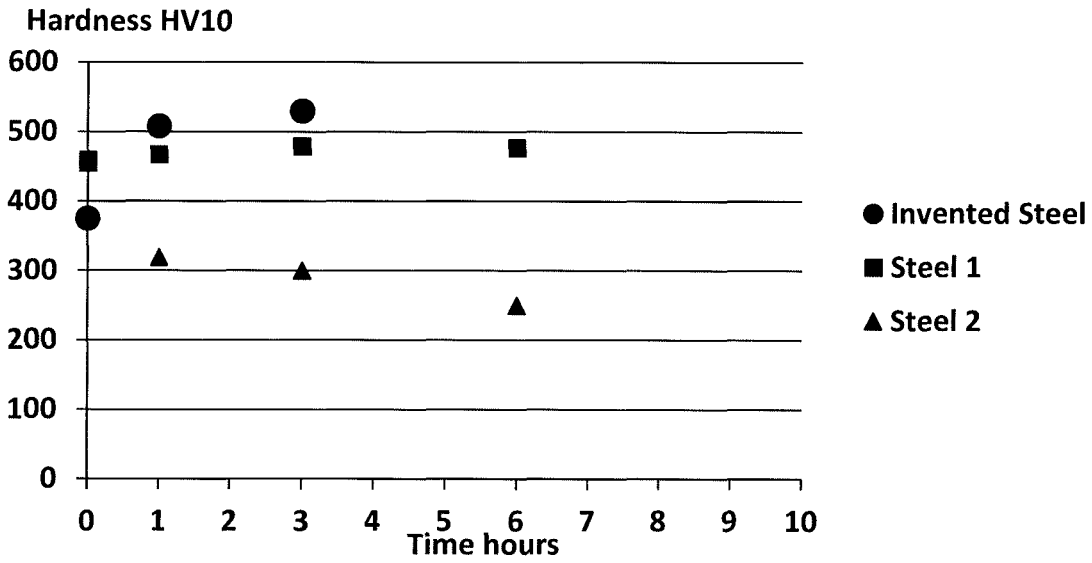
FIGS. 3*a* and 3*b* shows experimental data from a steel batch as described in the examples.
Figure 3B:
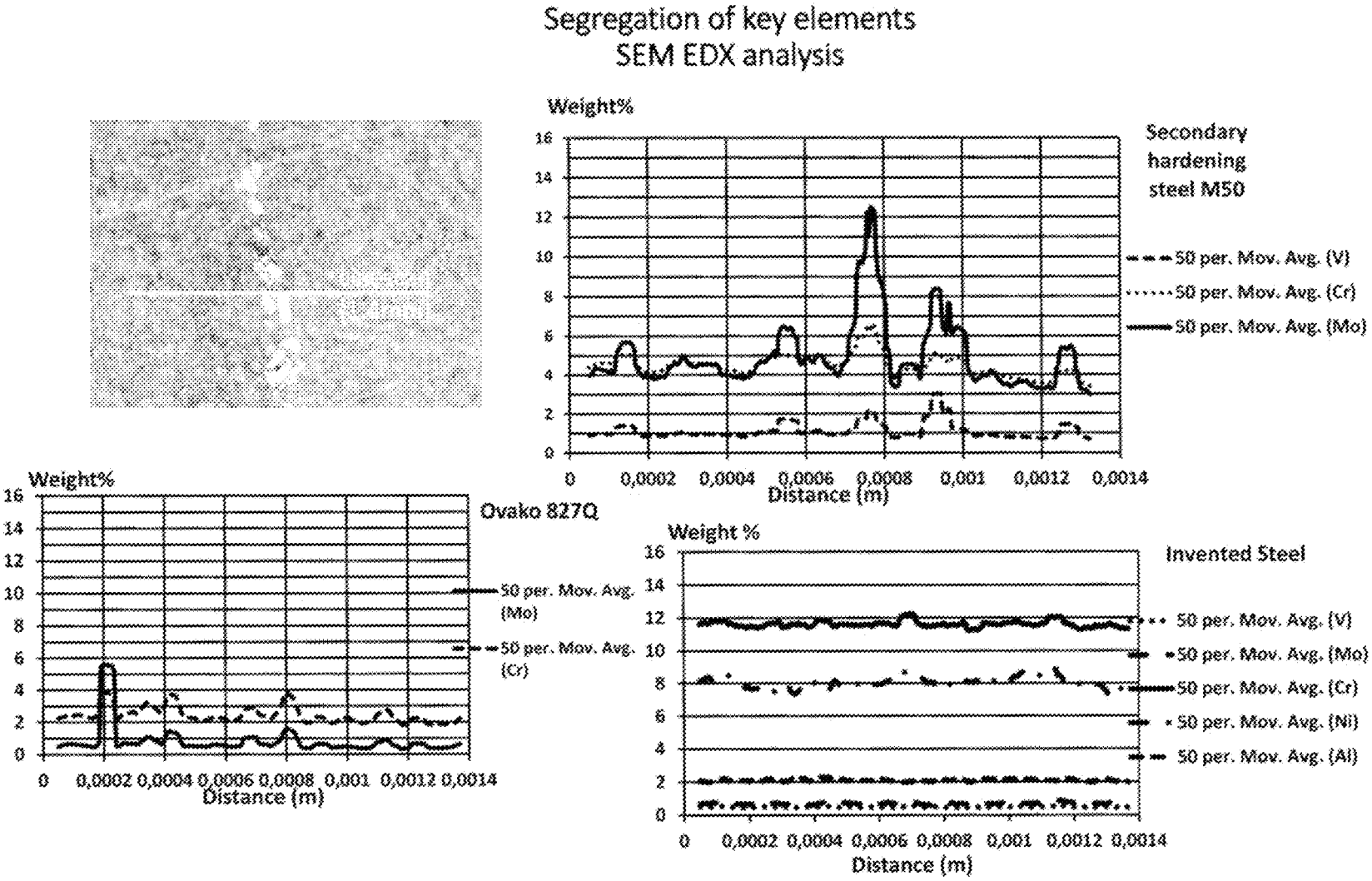

The tempering Hardness at 520° C. was measured on an automatic hardness tester KB30S. The result is shown in FIG. 3*a*. Further the segregation of key elements was also measured and the result if shown in FIG. 3*b*. The result is excellent compared to other comparative steels.

Figure 4:
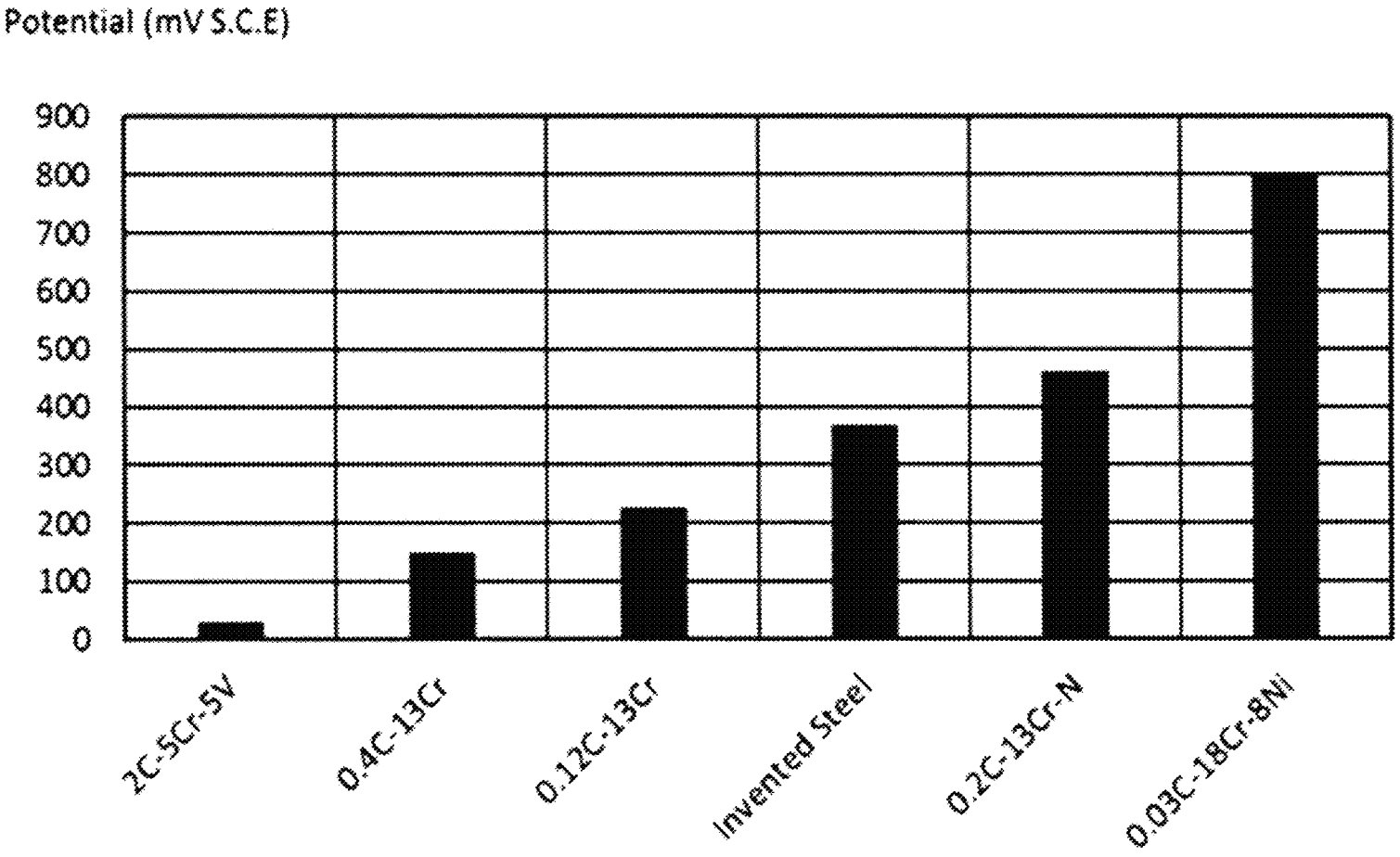
FIG. 4 shows the results of corrosion tests.

Corrosion tests were performed for this steel and a number of other steels. The test were performed according to ASTM G150 using 0.01M NaCl and potential sweep at 10-20 mV/min and measured at what voltage a 100 microA/cm2 current is generated. The results are shown in FIG. 4.

The invention claimed is:

1. A precipitation hardening stainless steel, said stainless steel comprising in wt %:

C: 0.05-0.30 wt %
Mo: 0.5-1.5 wt %
Al: 1.8-3 wt %
V: 0.25-1.5 wt %
Co: 0-0.03 wt %
Mn: 0-0.5 wt %
Si: 0-0.3 wt %
Ni: ≥9 wt % and <10 wt %
Cr: 10.5-13 wt % wherein impurities of nitrogen, oxygen, and sulfur are limited to 30 ppm each, remaining part up to 100 wt % is Fe, and impurity elements, wherein the steel comprises more than or equal to 80 wt % of a martensitic phase, with the remaining part made up of mainly an austenitic phase, wherein the composition of said stainless steel is within an area formed in a Schaeffler diagram, which diagram is based on the following equations:

$Cr_{eq}$=Cr+Mo+1.5*Si+0.5*Nb in wt % on the *x*-axis $Ni_{eq}$=Ni+30*C+0.5*Mn in wt % on the *y*-axis wherein the area in the Schaeffler diagram is defined by $11 \leq Cr_{eq} \leq 15.4$ and $10.5 \leq Ni_{eq} \leq 15$ in wt %, with the additional proviso that the amounts of Al and Ni also fulfil a formula Al=(Ni/4)±0.5 in wt %, and with the proviso that the amount of Al is 1.8 wt % if the formula results in an amount of Al lower than 1.8 wt % and that the amount of Al is 3 wt % if the formula results in an amount of Al exceeding 3 wt %.

2. The precipitation hardening stainless steel according to claim 1, wherein the amount of Co is less than 0.01 wt %.

3. The precipitation hardening stainless steel according to claim 1, wherein the precipitation hardening stainless steel comprises a first type of precipitations comprising Al and Ni and a second type of precipitations comprising carbides of at least one selected from the group consisting of Cr, Mo and V.

4. The precipitation hardening stainless steel according to claim 1, wherein the precipitation hardening stainless steel has a fatigue limit according to ASTM 468-90 at 250° C. of more than 700 MPa.

5. The precipitation hardening stainless steel according to claim 1, wherein the precipitation hardening stainless steel is nitrided.

6. The martensitic precipitation hardening stainless steel according to claim 1, wherein the steel comprises more than or equal to 90 wt % of a martensitic phase, with the remaining part made up of mainly an austenitic phase.

7. The precipitation hardening stainless steel according to claim 1, wherein:

C is 0.15 wt %
Mo is 0.7 wt %
Al is 2 wt %
V is 0.5 wt %
Mn is 0.3 wt %
Si is 0.3 wt %
Ni is 9.2 wt %
Cr is 12.2 wt %.

8. The martensitic precipitation hardening stainless steel according to claim 6, wherein:

C is 0.15 wt %
Mo is 0.7 wt %
Al is 2 wt %
V is 0.5 wt %
Mn is 0.3 wt %

Si is 0.3 wt %
Ni is 9.2 wt %
Cr is 12.2 wt %.

9. A method of manufacturing a part from the precipitation hardening stainless steel according to claim 1 wherein the precipitation hardening stainless steel is tempered at 510-530° C. for 1-8 hours to obtain precipitates comprising Ni and Al.

10. The method according to claim 9, wherein the precipitation hardening stainless steel is tempered for 6-8 hours.

11. The method according to claim 9, wherein the precipitation hardening stainless steel is machined before the precipitation hardening stainless steel is tempered.

12. The method according to claim 9, wherein solution treatment is carried out on the precipitation hardening stainless steel before the precipitation hardening stainless steel is tempered.

13. The method according to claim 12, wherein the solution treatment is carried out in the temperature interval 900-1000° C. during 0.2-3 hours.

14. The method according to claim 9, wherein nitriding is carried out on the precipitation hardening stainless steel.

* * * * *